United States Patent [19]

Tajima et al.

[11] Patent Number: 4,537,600

[45] Date of Patent: Aug. 27, 1985

[54] METHOD FOR THE PREPARATION OF PITCH-IN-WATER SLURRY

[75] Inventors: Hiroto Tajima, Yokohama; Hironori Kawakami, Kawasaki; Zenichi Mashino, Soka; Seinoshin Hayami, Yokohama; Osamu Ohzeki, Fukui, all of Japan

[73] Assignees: Chiyoda Chem. Engineering & Constr. Co., Yokohama; Nikka Chemical Industry Co., Ltd., Fukui, both of Japan

[21] Appl. No.: 593,827

[22] Filed: Mar. 27, 1984

[30] Foreign Application Priority Data

Mar. 30, 1983 [JP] Japan ..... 58-54847

[51] Int. Cl.[3] ..... C10L 1/30

[52] U.S. Cl. ..... 44/51; 44/61

[58] Field of Search ..... 44/51, 61, 6; 252/312; 241/21

[56] References Cited

U.S. PATENT DOCUMENTS

| | | | |
|---|---|---|---|
| 4,104,035 | 8/1978 | Cole et al. | 44/51 |
| 4,217,109 | 8/1980 | Siwersson et al. | 44/51 |
| 4,288,232 | 9/1981 | Schmolka et al. | 44/51 |
| 4,302,212 | 11/1981 | Yamamura et al. | 44/51 |
| 4,358,293 | 11/1982 | Mark | 44/51 |
| 4,441,887 | 4/1984 | Funk | 44/51 |

FOREIGN PATENT DOCUMENTS

| | | | |
|---|---|---|---|
| 1770 | of 1865 | United Kingdom | 44/61 |
| 261907 | 12/1926 | United Kingdom | 44/61 |

*Primary Examiner*—Y. Harris-Smith

*Attorney, Agent, or Firm*—Pahl, Lorusso & Loud

[57] ABSTRACT

Molten pitch, such as obtained in petroleum refining, is comminuted as such in the presence of water to obtain coarse pitch particles solidified during the comminution by contact with the water. The coarse pitch particles are further pulverized in the presence of water and, preferably, a dispersant to form a slurry containing the finely pulverized pitch particles dispersed in the water.

17 Claims, 2 Drawing Figures

METHOD FOR THE PREPARATION OF PITCH-IN-WATER SLURRY

BACKGROUND OF THE INVENTION

This invention relates to a method of preparing a pitch-in-water slurry.

As a result of the decrease of high petroleum crude oils in recent years, a need was increased for converting heavy, poor quality hydrocarbon oils into light hydrocarbon oils. Thus, a variety of petroleum refining plants have been constructed for the conversion of heavy oils into light oils by a solvent deasphalting method, a thermal cracking method, a catalytic cracking method or the like method. These processes unavoidably yield, as a by-product, pitch formed of extremely heavy hydrocarbon components. Since pitch has generally a lower content of ash and a higher calorific value than coal, it is desirable to utilize pitch as a fuel for various combustion installations. However, unlike liquid petroleum fuel, pitch is a solid at room temperature and, therefore, requires relatively high costs such as for transportation and storage. Further, since pitch in the molten state fails to exhibit a desired fluidity, it is not possible to use it as a fuel for combustion in a furnace wherein the fuel is pumped through pipes and sprayed from a burner nozzle.

In this circumstance, an attempt has been made to use pitch in the form of a slurry. Unlike solid or molten pitch, slurried pitch is easy to handle and store and, moreover, is able to be sprayed from a burner nozzle for combustion. In order to prepare a pitch-in-water slurry, it is generally necessary to resort to a method which includes various steps such as cooling of molten pitch for solidification, comminuting solidified pitch into particles suitable for transportation, finely pulverizing pitch particles by wet grinding or by dry grinding and, if necessary, mixing the finely pulverized pitch particles with water. Such a method additionally requires various devices and installations such as belt conveyors and silos, for transportation and storage.

SUMMARY OF THE INVENTION

In accordance with one aspect of the present invention, molten pitch is comminuted as such in the presence of water to obtain coarse pitch particles solidified during the comminution by contact with the water. The coarse pitch particles are further pulverized in the presence of water to form a slurry containing the finely pulverized pitch particles dispersed in the water.

When molten pitch is brought into contact with water, the surface hardens to form a shell while the center remains in the molten state. Upon being subjected to a mechanical force such as a shearing force, impact force, frictional force or a crushing force, the partly hardened pitch is comminuted into particles. The surfaces of the pitch particles newly formed by the comminution are continually hardened by contact with water. Since the pitch which is subjected to the comminution operation shows a behavior similar to liquid, the comminution may be performed much easily as compared with the grinding of lumps of solid pitch. Further, the resulting pitch particles are excellent in uniformity. The particle size of the coarse, intermediate pitch particles is preferably about 5 mm or less, more preferably between 0.1 and 2 mm.

The coarse pitch particles thus obtained are then finely pulverized to a particle size of preferably 350 μm or less, more preferably 150 μm or less, to form a pitch-in-water slurry. Since the coarse pitch particles have a uniform particle size, the pulverization may be carried out easily and efficiently.

The comminution operation and the succeeding pulverization operation may be effected in the same zone using the same pulverizing device. Any pulverizers may be utilized for this purpose so far as it has functions of liquid-liquid mixing, pulverizing solids into fine particles and dispersing fine particles into a liquid. Examples of such pulverizers include a continuous-type ball mill, a vibrating mill, a tower mill, a sand mill, an edge runner, a frictional disc mill, a stone-type colloid mill and a blade-type colloid mill. It is of course possible to conduct the comminution and pulverization steps in two separate zones using a combination of suitable two pulverizers.

It is an object of the present invention to provide a simple and economical method for the preparation of a pitch-in-water slurry.

Another object of the present invention is to provide a method for the preparation of a pitch-in-water slurry, which is free of steps involving handling of solids.

It is a special object of the present invention to provide a method in which molten pitch as produced, such as in petroleum refining processes, may be continuously transformed into fine particles dispersed in water.

It is a further object of the present invention to provide a method which can prepare a pitch-in-water slurry having a high pitch concentration of 50 weight % or more.

BRIEF DESCRIPTION OF THE DRAWING

Other objects, features and advantages of the present invention will become apparent from the detailed description of the invention which follows, when considered in light of the accompanying drawing, in which.

DETAILED DESCRIPTION OF THE PREFERRED EMBODIMENTS OF THE INVENTION

Figure 1:
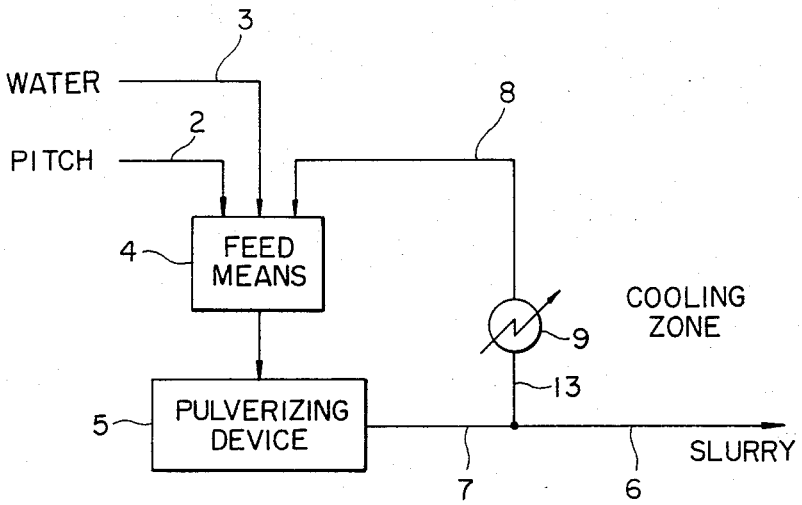
FIG. 1 is a flow diagram schematically illustrating a preferred embodiment of the apparatus useful for performing the method of this invention.

Any pitches, both natural and synthetic, may be used for the purpose of the present invention. Pitches derived from coal or petroleum are preferred raw materials for the preparation of the pitch-in-water slurry according to the present invention. Illustrative of suitable petroleum pitches are those obtained, as extraction residues, by deasphalting treatment of heavy hydrocarbon oils, such as vacuum residues, with a solvent such as propane or butane; those separated, as residues, from products of thermal cracking treatment of heavy hydrocarbon oils; those separated, as residues, from products of catalytic cracking treatment of petroleum fractions; and those separated, as residues, from products of the heat treatment of heavy hydrocarbon oils with superheated steam. Illustrative of suitable coal pitches are coal tar pitch and vacuum bottoms of liquified coal. Treated or reformed pitches obtained by thermally treating and/or hydrotreating the above petroleum-derived or coal-derived pitches may also be used for the purpose of the present invention. It is preferable to use pitches having a softening point of at least 50° C., more preferably at least 60° C.

The above-described raw material pitch is fed, in the molten state, to a pulverizing zone for comminution in the presence of water. In order to impart to the molten pitch a fluidity suitable for transportation through pipes, etc., it is preferred that the pitch be heated to a temperature higher by at least 50° C., more preferably by between 100° and 200° C., than its melting point. Molten pitch as produced in petroleum refining processes or coke plant may be suitably used as such in the method of this invention. Hardened pitch may of course be used as raw material pitch for the formation of the pitch-in-water slurry after being heated to a suitable temperature.

The method of this invention may be suitably operated in a continuous system, though a batch or semi-batch system may also be adopted. When the comminution and pulverization steps are carried out in a single pulverizer and the method of the present invention is conducted in a fully continuous mode, molten pitch is poured into the water contained in the pulverizer to form a slurry by operation of the pulverizer. After this start-up operation, molten pitch and water are fed, at predetermined feed rates, to the pulverizer while discharging a portion of the slurry therefrom to maintain the content of the mass therein within a predetermined range.

In this case, the concentration of the pitch in the slurry is determined by the feed rates of the molten pitch and water. However, the concentration of the pitch cannot exceed a certain limit, because the temperature of the slurry should not exceed 100° C. to prevent the boiling of the water of the slurry. For example, when the molten pitch has a specific heat of 0.6 Kcal/Kg.°C. and a temperature of 350° C. and when the water has a specific heat of 1.0 Kcal/Kg.°C. and a temperature of 20° C., the concentration of the pitch in the slurry cannot exceed about 35 weight % unless the process is operated under a pressurized condition. Thus, in the above method, in order to increase the concentration of the pitch in the slurry, it is necessary to lower the temperature of the molten pitch and/or the temperature of the water fed to the pulverizer.

According to preferred embodiments of the present invention, a pitch-in-water slurry having a high concentration, say 50 weight % or more, can be prepared without lowering the temperatures of the raw materials introduced into the pulverizing zone. These embodiments will be described below with reference to the accompanying drawing.

Referring first to FIG. 1, molten pitch is passed, preferably continuously, through a line 2 and is introduced into a pulverizing zone including a pulverizing device 5 such as a pulverizer or a mill, and a feed means 4 connected to the pulverizing device 5. Into the feed means 4 are also introduced water through a line 3 and a cooled material, hereinafter described, through a recycle line 8. The feed means 4 need not function as a mixing means. It suffices that the streams of the molten pitch, water and cooled material be joined with each other in the feed means 4 and fed to the pulverizing device 5. Thus, the feed means 4 can be a guide plate, a funnel, a downcomer tube or the like. The provision of the feed means 4 is not essential and the molten pitch, water and cooled material may be directly fed to the pulverizing device 5 jointly with or separately from each other.

The molten pitch introduced into the pulverizing device 5 through the feed means 4 is cooled by direct heat exchange with the water and the cooled material, also introduced thereinto through the feed means 4, and is finally solidified. Throughout the solidification of the molten pitch, the pitch is subjected to mechanical forces such as shearing force and crushing force so that the pitch is comminuted into particles of, for example 5 mm or less. The comminuted pitch is further finely pulverized to a desired particle size such as below 350 μm or less, whereby to form a slurry containing the finely pulverized solid pitch particles dispersed in water.

A portion of the thus formed slurry in the pulverizing device 5 is continuously discharged therefrom through a line 7 and is divided into first and second portions. The first portion is recovered through a line 6 as a pitch-in-water slurry product. The second portion is fed through a line 13 to a cooling zone 9, generally a heat exchanger, where it is cooled to a predetermined temperature. The cooled pitch is recycled through the recycle line 8 to the feed means 4 as the above-described cooled material.

The concentration of the pitch in the slurry recovered through the line 6 is determined by the feed rates of the molten pitch and water introduced into the pulverizing zone through the lines 2 and 3 and can be increased to any desired value. That is, a slurry of a high concentration such as of 50 weight % or more, especially of between 70 and 80 weight %, may be obtained according to the above method, while preventing the water in the pulverizing zone from boiling, by increasing the recycling rate of the slurry, i.e. increasing the amount of the second portion of the slurry passing through the lines 13 and 8 and/or enhancing the degree of cooling in the cooling zone, i.e. lowering the temperature of the cooled material. Generally, the cooling zone 9 is so arranged that the cooled slurry in the line 8 has a temperature 10°–70° C. lower than that in the line 13.

Figure 2:
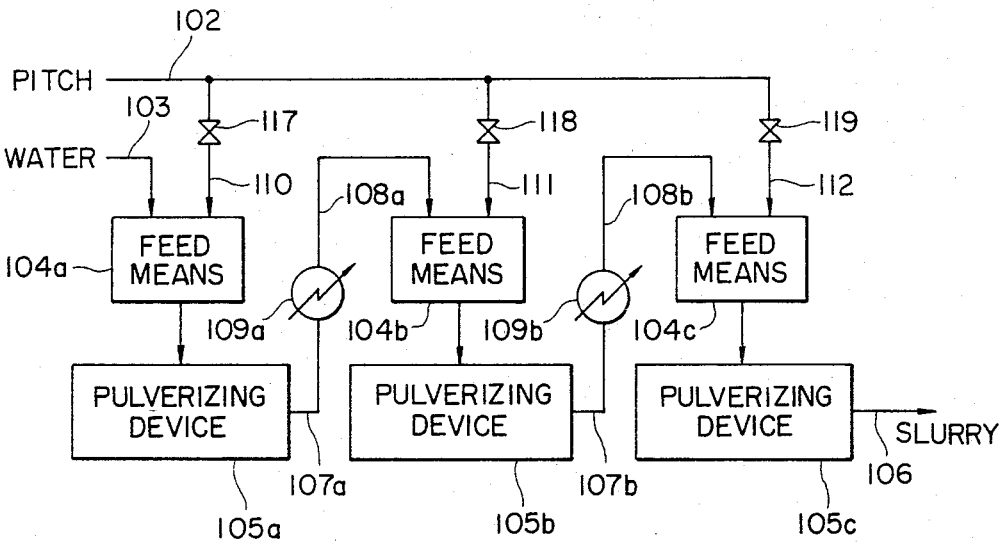
FIG. 2 is a flow diagram schematically illustrating an alternate embodiment of the present invention.

FIG. 2 illustrates another embodiment which is suitable for obtaining a highly concentrated pitch-in-water slurry, in which the component parts have been designated by the same reference numerals as part of a "100" series. The slurry preparation apparatus of this alternate embodiment is provided with two or more pulverizing zones connected in series with each other. In the particular embodiment shown in FIG. 2, there are provided three first, second and third pulverizing zones, respectively composed of first, second and third pulverizing devices 105*a*, 105*b* and 105*c*, and first, second and third feed means 104*a*, 104*b* and 104*c* connected to respective devices.

Molten pitch is passed through a line 102 and to the feed means 104*a*, 104*b* and 104*c* via lines 110, 111 and 112, respectively, which are branched from the line 102. Designated by the reference numerals 117, 118 and 119 are flow control valves for controlling the flow rates of molten pitch passing through the lines 110, 111 and 112, respectively. Water is fed to the first feed means 104*a* located at the upstream-end while first and second, water-containing cooled materials, hereinafter described, are fed to the other feed means 104*b* and 104*c*, respectively. Similarly to the case of FIG. 1, the feed means 104*a*, 104*b* and 104*c* may be deleted, if desired. In this case, molten pitch and water or a first or second cooled material are fed directly to respective pulverizing devices.

The molten pitch and water introduced into the first feed means 104*a* are passed to the first pulverizing device 105*a* to form a slurry in the same manner as described with reference to the embodiment of FIG. 1. A part of the slurry in the pulverizing device 105*a* is discharged therefrom through a line 107*a* and is fed to a first cooling zone 109*a* where it is cooled by, for example, heat exchange with a cooling medium. The cooled slurry is then introduced through a line 108*a* into the second feed means 104*b* as the above-described first, water-containing cooled material. In like manner, a part of the slurry formed in the pulverizing device 105*b* is fed through a line 107*b* to a second cooling zone 109*b* and the cooled slurry is fed through a line 108*b* to the third feed means 104*c* as the above-described second, water-containing cooled material. A portion of the slurry in the third pulverizing device 105*c*, located in the downstream-end, is discharged through a line 106 for recovery as the pitch-in-slurry product. When four or more pulverizing zones are employed, the operation is also the same as described above. That is, a portion of the slurry produced in one pulverizing zone is passed to its adjacent downstream-side pulverizing zone for cooling the molten pitch supplied to said adjacent zone and for forming a slurry therein.

The concentration of the pitch-in-water slurry recovered through the line 106 is determined by the feed rate of the molten pitch flowing through the line 102 and the feed rate of the water supplied through the line 103. Since, in the embodiment shown above, the molten pitch is divided into three streams for the introduction into three separate pulverizing zones and since cooling of the molten pitch is effected by cooled slurry formed in the previous stage except in the first pulverizing zone, the concentration of the pitch in the slurry product can be increased to any desired value, while maintaining the slurry in each pulverizing zone at below 100° C., by controlling the cooling performance of the cooling zones and/or increasing the number of the pulverizing zones.

In the foregoing embodiments, it is advisable to use a dispersant for the purpose of decreasing the viscosity of the slurry product and/or of stabilizing the dispersion of the pitch particles in the aqueous medium. Although any dispersant may be used for this purpose, it is preferable to use at least one of the following polyether compounds as the dispersant:

(A) a compound having the following general formula:

$$Z—(Y—X)_p$$

wherein

Z is an organic radical capable of forming, together with p number of hydrogen atom, an active hydrogen-containing organic compound of the formula $Z—(H)_p$ where H is the active hydrogen and p is a positive integer, Y is a polyoxyalkylene group consisting essentially of a plurality of monomer units, said monomer unit being at least one member selected from $—CH_2—CH_2—O—$ and $—CH_2—CHCH_3—O—$, X is a hydrogen atom, and p has the same meaning as above;

(B) a polymeric material obtained by crosslinking the compound (A) with a crosslinking agent;

(C) a salt of the sulfuric ester of the compound (A); and (D) a salt of the sulfuric ester of the polymeric material (B). In the case of compound (A) in which p is 2 or more, it is not necessary that the substituents —Y—X be the same.

Thus, the compound (A) is a polyaddition product obtained by reacting an active hydrogen-containing compound with an alkylene oxide. Preferably, the active hydrogen-containing compound $Z—(H)_p$ is a compound of the formula:

$$R—\underset{\underset{R'}{|}}{(NH)_p} \text{ or } R—(OH)_p$$

where R and R', independently of each other, are hydrogen or organic radicals and p has the same meaning as that described above.

Illustrative of suitable compounds of the formula $$R—\underset{\underset{R'}{|}}{(NH)_p}$$

are methylamine, ethylamine, propylamine, ammonia, ethylenediamine, hexamethylenediamine, diethyltriamine and triethylenetetramine.

Illustrative of suitable compounds of the formula $R—(OH)_p$ are methanol, ethanol, isopropyl alcohol, butyl alcohol, octyl alcohol, oleyl alcohol, stearyl alcohol, ethylene glycol, propylene glycol, butylene glycol, glycerin, trimethylol propane, triethanolamine, diglycerin, pentaerythritol, sorbitan, sorbitol, phenol, cresol, an alkylphenol, an alkylphenol-formaldehyde condensation product and a phenol-formaldehyde condensation product.

When both propylene oxide and ethylene oxide are used for the reaction with the active hydrogen-containing compound, i.e. when the polyoxyalkylene group Y is composed of both propylene oxide and ethylene monomer units, it is preferred that they are reacted to form a block copolymer chain rather than a random copolymer chain. It is also preferred that the monomers positioning at terminal end-side of the compound (A) be ethylene oxide monomers.

It is preferred that the polyoxyalkylene group Y of the compound (A) contain ethylene oxide monomer units and the total content of the ethylene oxide monomer units be in the range of between 40 and 98%, more preferably between 60 and 80%, based on the molecular weight of the compound (A). The molecular weight of the compound (A) is preferably between 1,000 and 100,000, more preferably between 5,000 and 50,000.

Compound (C) is a compound of the above general formula in which X is $—OSO_2M$ where M is a cation capable of forming, together with a $OSO_3$ anion, a salt. The compound (C) may be prepared by reacting the corresponding proton-type compound (A) with an esterification agent capable of forming a sulfuric ester, such as sulfuric acid, fuming sulfuric acid, chlorosulfonic acid or sulfamic acid, to form the ester and, then, neutralizing the ester with a neutralizing agent such as an organic or inorganic base. Illustrative of suitable neutralizing agents are sodium hydroxide, potassium hydroxide, ammonia, methylamine and ethanolamine.

The polymeric material (B) which serves as the dispersant according to the present invention is obtained by crosslinking the compound (A) with a crosslinking agent. Preferably, the crosslinking agent is selected from aldehydes and polyfunctional compounds having at least two functional groups selected from isocyanate, epoxy, carboxylic acid and carboxylic acid anhydride. Examples of suitable crosslinking agent include hexamethylene diisocyanate, tolylene diisocyanate, metaxylene diisocyanate, 4,4'-diphenylmethane diisocyanate, naphthylene diisocyanate, isophorone diisocyanate, ethylene glycol diglycidyl ether, polyethylene glycol diglycidyl ether propylene glycol diglycidyl ether, neopentyl glycol diglycidyl ether Bisphenol A diglycidyl ether, Bisphenol S diglycidyl ether, maleic acid, maleic anhydride, fumaric acid, formaldehyde and glyoxal.

The crosslinking may be performed by any conventional method, for example, by reacting the compound (A) with the crosslinking agent at a temperature of between 30° and 130° C. with stirring in the optional presence of the customarily employed acid or base catalyst. The amount of the crosslinking agent used for the reaction is preferably between 0.05 and 5 equivalents per one equivalent of the hydroxyl or sulfuric acid ester group of the polyalkylene group, i.e. between $0.05\times p$ and $5\times p$ (where p has the same meaning as above) moles per mole of the compound (A). It is preferred that the crosslinking be conducted so that between 10 and 90 mol % of the compound (A) is crosslinked.

The relationship between the compounds (B) and (D) is the same as that between the compounds (A) and (C). Thus, the compound (D) may be prepared by reacting the compound (B) in the same manner as that in the preparation of the compound (C) from the compound (A).

The polymeric materials (B) and (D) exhibit superior dispersing effect in comparison with the compounds (A) and (C) and the use of the polymeric material (B) or (D) as the dispersant is preferred. The amount of the dispersant in the pitch-containing composition of the present invention varies according to the amount and kind of the pitch and the kind of the dispersant. Preferably, the dispersant is used in an amount of between 0.1 and 2 parts by weight, more preferably between 0.2 and 1 parts by weight per 100 parts by weight of the pitch.

In addition, the incorporation of a phosphoric acid salt and/or a water-soluble polymeric substance into the pitch-in-water slurry is preferred because the homogenety of the dispersion is improved without adversely affecting the other properties such as fluidity and high gelation temperature. Examples of such a phosphoric acid salt include pyrophosphates, hexametaphosphates, tripolyphosphates and polymetaphosphates. Examples of the water-soluble polymeric substance include a polyethylene oxide, a polyvinyl alcohol, a polyacrylamide, a methyl cellulose, a carboxymethyl cellulose, hydroxyethyl cellulose, hydroxypropyl cellulose, hydroxypropylmethyl cellulose, a guar gum a hydroxypropyl guar gum and a carboxymethylhydroxypropyl guar gum. It is preferred that the water-soluble polymeric substance have a molecular weight of at least 1,000. The content of the phosphoric acid salt is preferably in the range of between 0.01 and 0.5 parts by weight, more preferably between 0.03 and 0.1 parts by weight per 100 parts by weight of the pitch. The content of the water-soluble polymeric substance is in the range of between 0.001 and 0.5 parts by weight, more preferably between 0.005 and 0.1 parts by weight per 100 parts by weight of the pitch.

Further, various other additives may be incorporated into the pitch-in-water slurry. For example, an auxiliary fuel, an agent for decreasing the sulfur and/or nitrogen compounds in the combustion gas and an ash-reforming agent may be suitably added to the slurry when the slurry is used as fuel. When the slurry is used as raw material for reactions such as gasification, an auxiliary reactant and a catalyst may suitably incorporated into the slurry. The above-described various additional components such as dispersant may be fed to the pulverizing zone or zones after being mixed with the water supplied through the line 3 or 103 (FIGS. 1 and 2) or directly by themselves.

The following examples will further illustrate the present invention.

EXAMPLE 1

Using the system shown in FIG. 1, a pitch having a melting point of 180° C. and exhibiting a viscosity of about 2000 centipoises at 350° C. was processed for the production of a pitch-in-water slurry. The raw material pitch was a residual product obtained by thermal cracking of a vacuum residue. The pitch maintained at 350° C. was continuously fed at a feed rate of 50 Kg/hr to the feed means 4 through the line 2 by means of a gear pump. To the feed means was also fed at a feed rate of 21.4 Kg/hr an aqueous liquid containing a dispersant and hydroxypropylmethyl cellulose and having a temperature of 20° C. The amounts of the dispersant and the cellulose contained in the aqueous liquid were such that the pitch-in-water slurry had contents of the dispersant and cellulose of 0.35 weight % and 0.035 weight %, respectively. The dispersant was an ammonium salt of the sulfuric ester of a polyether compound obtained by addition polymerization of propylene oxide with ethylenediamine, serving as active hydrogen-containing compound, followed by addition polymerization of ethylene oxide. The polyether compound had a molecular weight of about 12,000 and had contents of propylene oxide and ethylene oxide monomer units of 4,690 and 9,250, respectively, in terms of molecular weight.

The feed means 4 was a guide plate mounted at the top of a vertical pulverizer 5 and slanted by 30° from the vertical plane. The aqueous liquid from the line 3 and a cooled material (hereinafter described) from the line 8 ran down on the plate to form a liquid layer running thereon. The molten pitch at 350° C. passed through the line 2 and a nozzle, and ran as a stream on top of the running liquid layer on the guide plate. The molten pitch and the aqueous liquid were thus introduced into the pulverizer 5 to obtain a slurry.

The pulverizer 5 was a blade-type colloid mill ("TRIGONAL" manufactured by SIEFER AG) and was operated under the following conditions:

| | |
|---|---|
| Revolutional speed of rotary blade | 3,000 r.p.m. |
| Output | 3.8 KW |
| Space of rotary blade | 0.35 mm |
| Diameter of rotary blade | 180 mm |

The slurry in the pulverizer 5 having a temperature of about 50° C. was continuously discharged therefrom at a rate of 371.4 Kg/hr and was introduced into the cooling zone 9 where it was cooled to 20° C. 300 Kg/hr of the thus cooled slurry was returned to the feed means 4 through the line 8 as the cooled material (hereinabove described), while the remaining 71.4 Kg/hr of the cooled slurry was recovered as the pitch-in-water slurry. The slurry thus obtained had a pitch content of 70 weight % and an average particle size of about 20

μm and exhibited an apparent viscosity of 200 centipoises at 25° C. The particle size of the largest particle in the slurry was about 200 μm. No sedimentation was formed when the slurry was allowed to stand quiescently for 2 weeks.

EXAMPLE 2

The pitch used as the raw material in Example 1 was used in this example, too. The pitch was processed using the apparatus shown in FIG. 2 to form a pitch-in-water slurry. The operational conditions (materials flowing through the lines 102, 110, 111, 112, 103, 107*a*, 108*a*, 107*b*, 108*b* and 106 and the flow rates, temperatures and pitch contents thereof) in the stationary state were as shown in Table 1. As the feed means 104*a*–104*c* and pulverizing devices 105*a*–105*c*, the guide plates and the colloid mills similar to those used in Example 1 were used. The same dispersant and cellulose as used in Example 1 were also used in this example in the similar amounts and were fed to the pulverizing device 105*a* in the same manner as that in Example 1. The resultant slurry had an excellent stability and was found to be used as a fuel.

TABLE 1

| Line in FIG. 2 | Material | Flow rate (Kg/hr) | Temperature (°C.) | Pitch content (wt %) |
|---|---|---|---|---|
| 102 | Molten pitch | 70 | 350 | — |
| 110 | Molten pitch | 15 | 350 | — |
| 111 | Molten pitch | 22 | 350 | — |
| 112 | Molten pitch | 33 | 350 | — |
| 103 | Aqueous liquid | 30 | 20 | — |
| 107a | Slurry | 45 | 90 | 33 |
| 108a | Slurry | 45 | 20 | 33 |
| 107b | Slurry | 67 | 90 | 55 |
| 108b | Slurry | 67 | 20 | 55 |
| 106 | Slurry | 100 | 90 | 70 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. A method of preparing a pitch-in-water slurry, comprising the steps of:

mechanically molten pitch in the presence of water to obtain coarse pitch particles solidified during the comminution by contact with the water, and finely pulverizing the coarse pitch particles in the presence of water to form a slurry containing the finely pulverized pitch particles dispersed in the water.

2. A method as claimed in claim 1, wherein said comminuting and said pulverizing steps are carried out so that the coarse pitch particles have a particle size of about 5 mm or less and the finely pulverized pitch particles have a particle size of about 350 μm or less.

3. A method as claimed in claim 1, wherein said comminuting and said pulverizing steps are carried out with the use of the same pulverizing device.

4. A method as claimed in claim 1, wherein said comminuting and said pulverizing steps are carried out with the use of two or more separate pulverizing devices, respectively.

5. A method as claimed in claim 1, wherein said pulverizing step is performed in the presence of a dispersant.

6. A method of preparing a pitch-in-water slurry product, comprising the steps of:

feeding molten pitch, water and a cooled, recycled pitch-in-water slurry to a pulverizing zone;

pulverizing, in the pulverizing zone, the molten pitch to obtain pulverized pitch particles solidified during the pulverization by contact with the water and the cooled recycle slurry and to form a slurry containing the pulverized and solidified pitch particles dispersed in the water;

withdrawing at least a part of said slurry from said pulverizing zone;

dividing the withdrawn slurry into first and second portions;

recovering said first portion as the pitch-in-water slurry product;

cooling said second portion; and recycling said cooled second portion to said pulverizing zone as said cooled, recycled pitch-in-water slurry.

7. A method as claimed in claim 6, wherein said pulverizing step is carried out so that the pulverized and solidified pitch particles have a particle size of about 350 μm or less.

8. A method as claimed in claim 6, further comprising feeding a dispersant to the pulverizing zone.

9. A method of preparing a pitch-in-water slurry product, comprising the steps of:

providing two or more pulverizing zones each equipped with a mechanical pulverizer connected in series, including an upstream end pulverizing zone and a downstream end pulverizing zone;

feeding molten pitch and water to the upstream-end pulverizing zone;

feeding molten pitch and a cooled, recycled pitch-in-water slurry to each of the zone or zones other than the upstream-end pulverizing zone;

pulverizing in each pulverizing zone the molten pitch to obtain pulverized pitch particles solidified during the pulverization by contact with the water or the cooled, recycled pitch-in-water slurry and to form a slurry containing the pulverized and solidified pitch particles dispersed in water;

withdrawing a portion of the slurry from each zone;

cooling the slurry withdrawn from each of the zone or zones other than the downstream-end pulverizing zone and introducing the cooled slurry to its adjacent downstream-side pulverizing zone as the cooled, recycled pitch-in-water slurry; and recovering the slurry withdrawn from the downstream-end pulverizing zone as the pitch-in-water slurry product.

10. A method as claimed in claim 9, wherein said pulverizing step is carried out so that the pulverized and solidified pitch particles have a particle size of about 350 μm or less.

11. A method as claimed in claim 9, further comprising feeding a dispersant to the upstream-end pulverizing zone.

12. The method of claim 1 wherein said pitch is at a temperature at least 50° C. above its melting point prior to introduction into the presence of water for comminution.

13. The method of claim 6 wherein said pitch is at a temperature at least 50° C. above its melting point prior to introduction into the presence of water for comminution.

14. The method of claim 9 wherein said pitch is at a temperature at least 50° C. above its melting point prior to introduction into the presence of water for comminution.

15. The method of claim 1 wherein the surfaces of the molten pitch particles newly formed by the comminution are continually hardened by contact with the water.

16. The method of claim 6 wherein the surfaces of the molten pitch particles newly formed by the comminution are continually hardened by contact with the water.

17. The method of claim 9 wherein the surfaces of the molten pitch particles newly formed by the comminution are continually hardened by contact with the water.

* * * * *

UNITED STATES PATENT AND TRADEMARK OFFICE

CERTIFICATE OF CORRECTION

PATENT NO. : 4,537,600

DATED : August 27, 1985

INVENTOR(S) : Hiroto TAJIMA et al

It is certified that error appears in the above—identified patent and that said Letters Patent is hereby corrected as shown below:

Claim 1, Line 3 (Column 9, line 51), after "mechanically" insert --comminuting--.

Signed and Sealed this

*Fourteenth* Day of *January 1986*

[SEAL]

*Attest:*

DONALD J. QUIGG

*Attesting Officer*

*Commissioner of Patents and Trademarks*